US005519912A

United States Patent [19]

Kawamura

[11] Patent Number: 5,519,912

[45] Date of Patent: May 28, 1996

[54] HAIRBRUSH HAVING MEANS TO COLLECT TRAPPED STRANDS OF HAIR FOR REMOVAL FROM THE BRISTLES

[76] Inventor: Shigemasa Kawamura, 5952 Appian Way, Long Beach, Calif. 90803

[21] Appl. No.: 419,749

[22] Filed: Apr. 10, 1995

[51] Int. Cl.[6] ..... A46B 17/06

[52] U.S. Cl. ..... 15/160; 15/169; 15/184; 15/246; 119/628; 132/119

[58] Field of Search ..... 15/159.1, 160, 15/169, 184, 246; 119/88; 132/119

[56] References Cited

U.S. PATENT DOCUMENTS

| | | | |
|---|---|---|---|
| 1,303,500 | 5/1919 | Rosenberg | 15/169 |
| 2,529,927 | 11/1950 | Fisk | 15/246 |
| 2,916,757 | 12/1959 | Peilet et al. | 15/169 |
| 3,065,757 | 11/1962 | Peilet | 15/184 |
| 3,108,305 | 10/1963 | Peilet | 119/88 |
| 3,577,580 | 5/1971 | Rand | 132/119 |
| 4,225,997 | 10/1980 | Thomas et al. | 15/169 |
| 4,517,703 | 5/1985 | Koke | 15/246 |
| 5,133,103 | 7/1992 | Nagasawa | 15/184 |

FOREIGN PATENT DOCUMENTS

| | | | |
|---|---|---|---|
| 289465 | 11/1988 | European Pat. Off. | 15/160 |
| 7546 | of 1838 | United Kingdom | 15/169 |
| 14033 | of 1887 | United Kingdom | 15/169 |
| 691088 | 5/1953 | United Kingdom | 15/246 |
| 794594 | 5/1958 | United Kingdom | 15/184 |
| 1587494 | 4/1981 | United Kingdom | 15/169 |

*Primary Examiner*—Mark Spisich
*Attorney, Agent, or Firm*—Hawes & Fischer

[57] ABSTRACT

Hairbrushes are disclosed having an array of bristles for grooming either humans or animals. Loose strands of hair that become trapped among the bristles during the brushing strokes are collected and relocated for quick and easy removal from the brush. The foregoing is achieved by either sliding a hair collecting plate axially along the bristles or by moving a bristle carrying plate to which the bristles are connected through a hollow brush head so that the bristles slide axially through holes formed in the top of the brush head.

6 Claims, 5 Drawing Sheets

HAIRBRUSH HAVING MEANS TO COLLECT TRAPPED STRANDS OF HAIR FOR REMOVAL FROM THE BRISTLES

BACKGROUND OF THE INVENTION

1. Field of the Invention

This invention relates to hairbrushes, particularly those used to groom the hair of either humans or animals, and to means that facilitates collecting loose strands of hair that have been trapped during the brushing strokes so that the hair can be removed and the brush cleaned.

2. Background Art

Hairbrushes have long been used to groom humans and animals. However, when brushing relatively long and/or coarse hair, it is not uncommon for many strands of hair to be removed by the brush after only a few strokes. Such loose strands of hair are usually trapped within the bristles of the brush. In the case where many strands of hair accumulate among the bristles, cleaning the brush can be both inconvenient and time-consuming. That is to say, the loose strands of hair are typically removed by hand from the brush, one at a time. It would therefore be desirable to have a more efficient way to remove loose strands of hair that have become trapped within the bristles of a hairbrush during the brushing strokes so that the brush can be quickly and easily cleaned.

SUMMARY OF THE INVENTION

In general terms, hairbrushes for grooming humans or animals are disclosed having an array of bristles and a brush head from which the bristles extend. Loose strands of hair that become trapped among the bristles during the brushing strokes are collected for removal by either sliding a hair collecting plate axially along the bristles or by moving a bristle carrying plate to which the bristles are connected through a hollow brush head so that the bristles slide axially through holes formed in the brush head.

In one case, the hair collecting plate has an array of holes through which respective bristles are received. First ends of the bristles are secured to the brush head, and relatively wide buttons are affixed to the opposite ends. The hair collecting plate slides axially along the bristles between the brush head and the buttons to collect loose strands of hair for removal from the bristles. However, the buttons prevent the hair collecting plate from sliding off the bristles and becoming detached from the brush.

In a second case, a flexible hinge is connected at each end of the brush between the brush head and the hair collecting plate. The hinges are adapted to articulate between collapsed and opened positions as the hair collecting plate slides axially along the bristles. The hinges articulate to the opened position to prevent the hair collecting plate from sliding off the bristles and becoming detached from the brush.

In a third case, the hair collecting plate slides axially along an array of bristles and a set of guide posts that run parallel to the bristles. First ends of the guide posts are secured to the brush head and relatively wide buttons are affixed at the opposite ends. The buttons prevent the hair collecting plate from sliding off the guide posts and becoming detached from the bristles.

In a fourth case, the brush head is of hollow construction having a closed top and an open bottom. An array of holes is formed through the top of the brush head through which respective bristles are received. First ends of the bristles are secured to a bristle carrying plate that is adapted to move through the hollow brush head, and relatively wide buttons are affixed to the opposite ends. As the bristle carrying plate moves through the hollow brush head and outwardly from the open bottom thereof, the bristles slide axially through the holes in the top. However, the buttons prevent the bristles from sliding out of engagement with the brush head and becoming detached from the brush.

In a fifth case, a bristle carrying plate is adapted to move through a compact, easy to carry brush body having a closed top and an open bottom. As the bristle carrying plate moves through the hollow brush body to extend across the open bottom thereof, buttons carried by the bristles prevent the bristle carrying plate from exiting the bottom of the brush body and the bristles from becoming detached from the brush.

DETAILED DESCRIPTION

Figure 1:
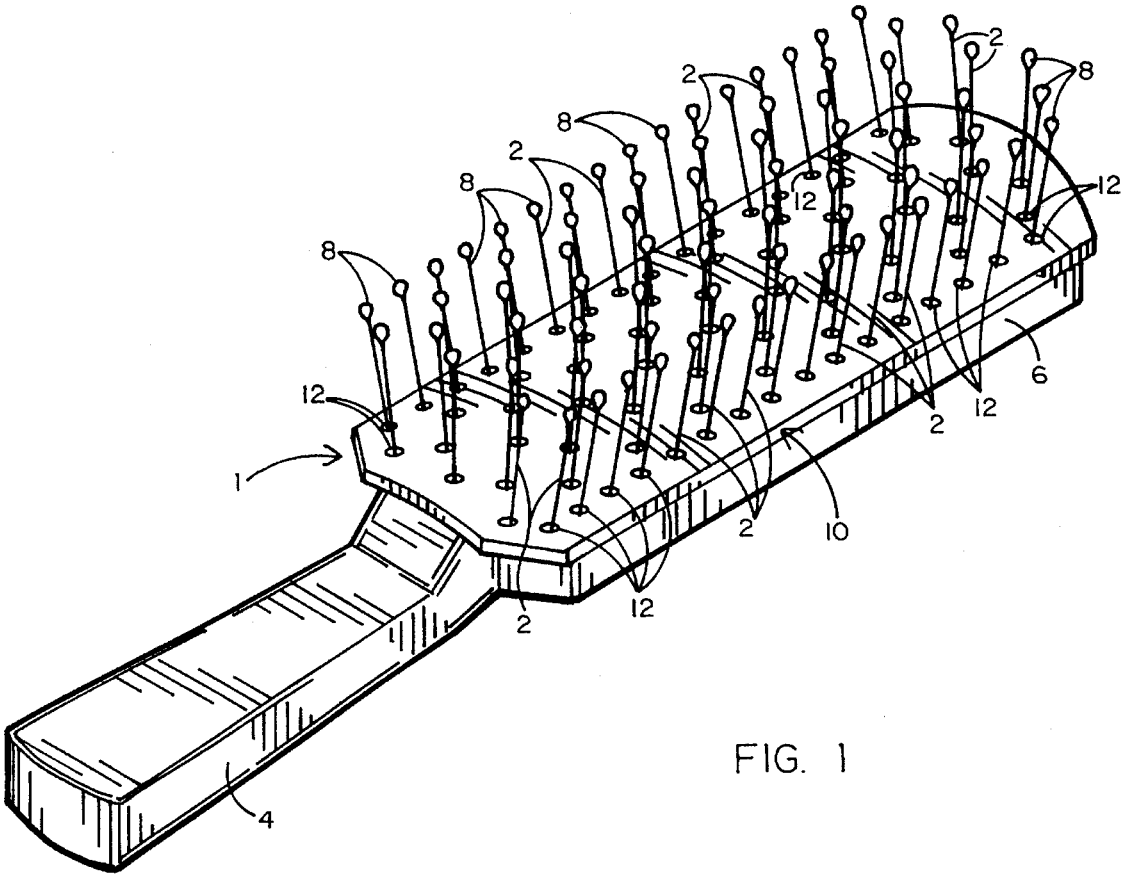
FIG. 1 is a perspective view of a hairbrush having a hair collecting plate according to a first embodiment of the present invention.
Figure 2:
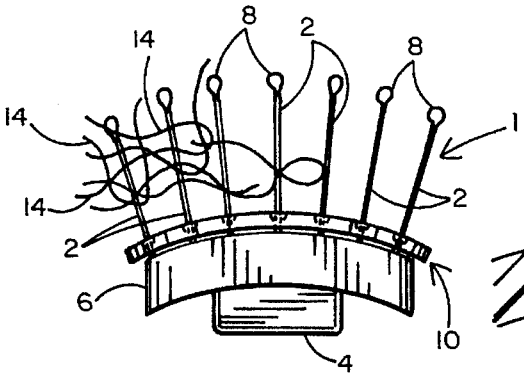
FIG. 2 is an end view of the hairbrush of FIG. 1 with the hair collecting plate in an at-rest position.
Figure 3:
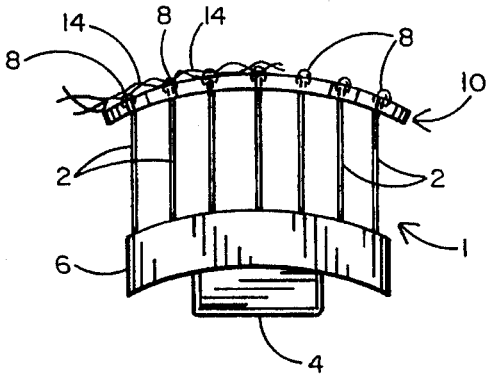
FIG. 3 is an end view of the hairbrush of FIG. 1 with the hair collecting plate moved to a brush cleaning position.

A first embodiment of a hairbrush 1 having means to collect loose strands of animal and human hair that are trapped among bristles 2 thereof so that the hair may be quickly and easily removed from the hairbrush for disposal is described while referring concurrently to FIGS. 1–3 of the drawings. As is best shown in FIG. 1, the hairbrush 1 includes a conventional gripping handle 4 at one end of the brush coextensively connected to an elongated head 6 at the opposite end. An array of thin bristles 2 projects upwardly and outwardly from the brush head 6.

Typically, the handle 4 and head 6 of hairbrush 1 are manufactured from plastic, although the material used to form hairbrush 1 is not to be regarded as a limitation of this invention. In the embodiment illustrated by FIGS. 1–3, the bristles 2 are manufactured from a flexible plastic material so that the bristles may bend during the brushing strokes. However, the bristles 2 may also be manufactured from a relatively rigid material should the brush be used specifically for grooming animals. The bristles 2 are individually arranged in generally spaced, parallel alignment with one another. One end of each bristle 2 is secured to the brush head 6. Affixed to the opposite end of each bristle 2 is a smooth, generally spherical button 8. The thickness of each bristle 2 is less than the thickness of the button 8 carried thereon. The buttons 8 are applied to the bristles 2 by any suitable method including a process of first dipping the ends of the bristles 2 in a bath of hot plastic melt and then removing the bristles from the bath to permit the plastic to cool.

In accordance with the improvement of FIGS. 1–3, a hair collecting plate 10 is coupled to the hairbrush 1. It is preferable that the hair collection plate 10 be relatively thin and have a configuration that conforms to the shape of the brush head 6. An array of holes (designated 12 and best shown in FIG. 1) are formed through the hair collecting plate 10. The number and location of the holes 12 formed through plate 10 correspond to the number and location of the bristles 2 projecting from the head 6 of hairbrush 1. However, there may be more holes 12 in plate 10 than bristles 2 secured to brush head 6. The holes 12 are suitably sized to slidably receive the bristles 2 therethrough while maintaining bristles 2 and plate 10 in close frictional engagement with one another.

The hair collecting plate 10 is coupled to the hairbrush 1 by sliding the array of bristles 2 projecting from brush head 6 through respective holes 12 formed in plate 10. It is preferable that the hair collecting plate 10 be coupled to the brush 1 in the manner just described prior to the step of affixing the buttons 8 to the ends of the bristles 2. In the assembled condition, the hair collection plate 10 is adapted to slide axially along the bristles 2 from an at-rest position closest to and flush against the brush head 6 (best shown in FIG. 2) to a brush cleaning position farthest from the brush head 6 (best shown in FIG. 3). However, it may be appreciated that the size of the wide buttons 8 relative to the thinner bristles 2 on which the buttons 8 are carried blocks the removal of the hair collecting plate 10 from the bristles 2 and the decoupling of plate 10 from hairbrush 1 when the plate 10 is moved along the bristles 2 to the brush cleaning position of FIG. 3.

Figure 1A:
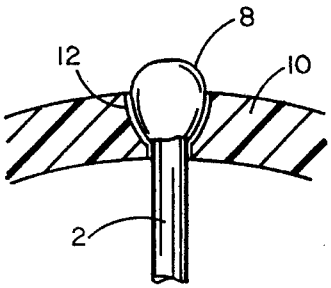
FIG. 1*a* shows a variation in the holes form through the hair collecting plate of FIG. 1.

As is shown in FIG. 1*a* of the drawings, the holes 12 in the hair collecting plate 10 form pockets for receiving respective buttons 8 therewithin when plate 10 is moved to the brush cleaning position of FIG. 3. With the buttons 8 seated in the pockets of holes 12, it will be easier to clean the brush 1 by removing the hairs collected thereby.

During use, with the hair collecting plate 10 initially in the at-rest position of FIG. 2, the hairbrush 1 is used in the usual manner for grooming either humans or animals. The strands of loose hair 14 shown in FIG. 2 which are trapped among the bristles 2 during the brush strokes are collected and carried away from the brush head 6 by relocating the hair collecting plate 10 to the brush cleaning position of FIG. 3. That is, by sliding the hair collecting plate 10 axially and upwardly along the bristles 2, the hair 14 that is distributed among the bristles 2 is collected and moved to a common location atop brush 1 at which the hair may be efficiently and completely removed. Thus, the hairbrush 1 is quickly and easily cleaned without having to remove the hair 14 strand-by-strand. To reuse the hairbrush 1 after cleaning, the hair collecting plate 10 is returned to the at-rest position of FIG. 2 by simply sliding plate 10 axially and downwardly along the bristles 2 so as to lie flush against the brush head 6.

Figure 4:
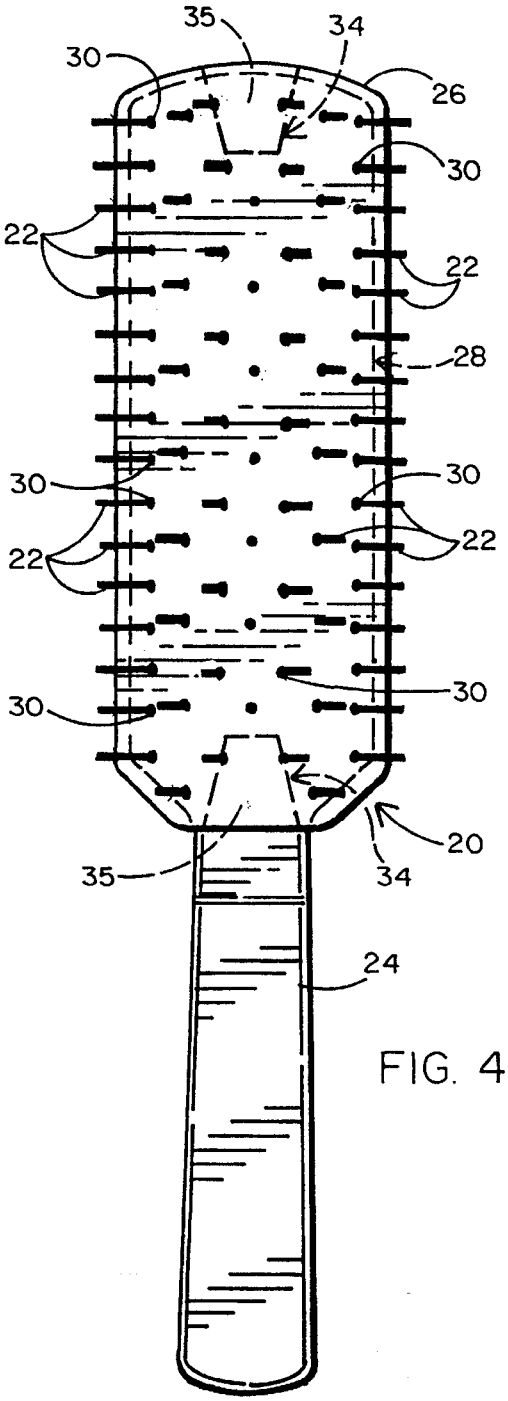
FIG. 4 is a top view of a hairbrush having a hair collecting plate according to a second embodiment of the present invention.
Figure 5:
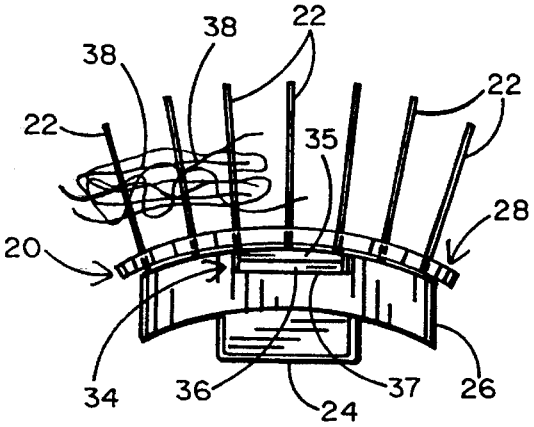
FIG. 5 is an end view of the hairbrush of FIG. 4 with the hair collecting plate in an at-rest position.
Figure 6:
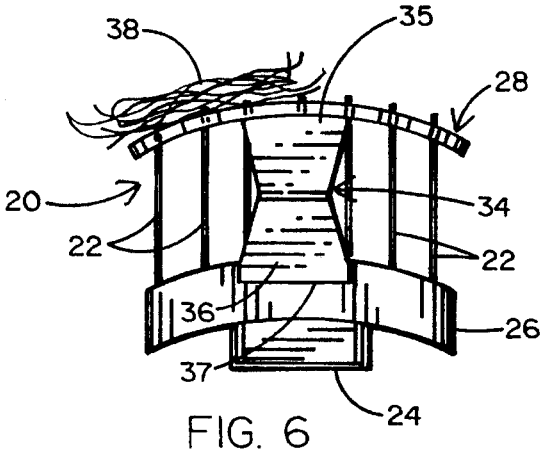
FIG. 6 is an end view of the hairbrush of FIG. 4 with the hair collecting plate moved to a brush cleaning position.

A second embodiment of a hairbrush 20 having means to collect loose strands of animal and human hair that are trapped among bristles 22 thereof so that the hair can be quickly and easily removed from the brush for disposal is described while referring concurrently to FIGS. 4–6 of the drawings. As is best shown in FIG. 4, the hairbrush 20 includes a conventional gripping handle 24 located at one end that is coextensively connected to an elongated head 26 at the opposite end. An array of thin (e.g. flexible) bristles 22 projects upwardly and outwardly from the brush head 26. Each of the bristles 22, handle 24, and head 26 of hairbrush 20 of FIGS. 4–6 is manufactured from plastic, although the material used to manufacture the bristles may depend on whether the brush 20 is used to groom humans or animals. The bristles 22 are individually arranged in generally spaced, parallel alignment with one another with one end of each bristle being secured to the brush head 26.

In accordance with the improvement of FIGS. 4–6, a hair collecting plate 28 is coupled to the hairbrush 20. The hair collecting plate 28 of FIGS. 4–6 is identical to that identified by reference numeral 10 and described while referring to FIGS. 1–3 and, therefore, only a brief description of plate 28 will be provided. It is preferable that the hair collecting plate 28 be relatively thin and have an array of holes (designated 30 and best shown in FIG. 4) formed therethrough. The holes 30 are suitable sized to slidably receive therethrough the bristles 22 projecting from the brush head 26 while maintaining the bristles 22 and plate 28 in close frictional engagement with one another. In this regard, the hair collecting plate 28 is coupled to the hairbrush 20 by sliding the array of bristles 22 through respective holes 30 formed in plate 28. Therefore, the hair collecting plate 28 is adapted to slide axially along the bristles 22 from an at-rest position closest to and flush against the brush head 26 (best shown in FIG. 5) to a brush cleaning position farthest from the brush head 26 (best shown in FIG. 6).

However, unlike the hairbrush 1 of FIGS. 1–3 and the associated bristles 2 thereof to which buttons 8 are attached, the bristles 22 associated with the hairbrush 20 of FIGS. 4–6 are free-ended (i.e. devoid of the aforementioned buttons). Therefore, the holes 30 through hair collecting plate 28 are devoid of the pockets illustrated in FIG. 1*a*. The hairbrush 20 is provided with a pair of identical hinges 34 at opposite ends of the brush head 26 to prevent the removal of the hair collecting plate 28 from the bristles 22 and the decoupling of plate 28 from hairbrush 20 when the plate 28 is moved upwardly along the bristles 22 to the brush cleaning position of FIG. 6.

More particularly, the hinges 34 may be formed from a thin flexible plastic or other suitable material. Each hinge 34 includes an upper hinge member 35 and a lower hinge member 36. Hinges 34 are adapted to bend so that the upper and lower hinge members 35 and 36 can rotate relative to one another at the intersection therebetween. The upper hinge member 35 of hinges 34 are bonded to and movable with the hair collecting plate 28, and the lower hinge members 36 are bonded to the brush head 26. Such bonding of the upper and lower hinge members 35 and 36 of hinges 34 may be accomplished adhesively or by encapsulating ends of the hinge members 35 and 36 within the hair collecting plate 28 and the head 26 during manufacture of the brush 20. Hence, the hinges 34 are adapted to articulate between collapsed and opened positions as the hair removal plate 28 is moved from the at-rest position of FIG. 5 to the brush cleaning position of FIG. 6. Short pockets 37 may be formed in opposite ends of the brush head 26 to receive the hinges 34 therewithin as the hinge members 35 and 36 are rotated to the collapsed position when hair collecting plate 28 is in at-rest position of FIG. 5.

During use, with the hair collecting plate 28 initially in the at-rest position of FIG. 5, the hairbrush 20 is used in the usual manner for grooming either animals or humans. The strands of loose hair 38 shown in FIG. 5 which are trapped among the bristles 22 during the brush strokes are collected and carried away from the brush head 26 by relocating the hair collecting plate 28 to the brush cleaning position of FIG. 6. Thus, by sliding the hair collecting plate 28 axially and upwardly along the bristles 22, the hair 38 that is distributed among the bristles 22 is collected and moved to a common location atop the brush 20 to permit the removal and disposal thereof.

It may be appreciated that as the hair collecting plate 28 is moved upwardly towards the brush cleaning position of FIG. 6, the hinges 34 at opposite ends of brush head 26 articulate from the collapsed position, with the hinge members 35 and 36 disposed face-to-face one another within pockets 37, to the open position. That is to say, in the open position, the upper and lower hinge members 35 and 36 extend linearly relative to one another between the brush head 26 and the hair collecting plate 28 so as to prevent the hair collecting plate 28 from sliding off the free ends of the bristles 22. To reuse the hairbrush 20 after cleaning, the hair collecting plate 28 is returned to the at-rest position of FIG. 5 by simply sliding plate 28 axially and downwardly along the bristles 22 towards brush head 26, whereupon the hinges 34 are collapsed between brush head 26 and hair collecting plate 28.

Figure 7:
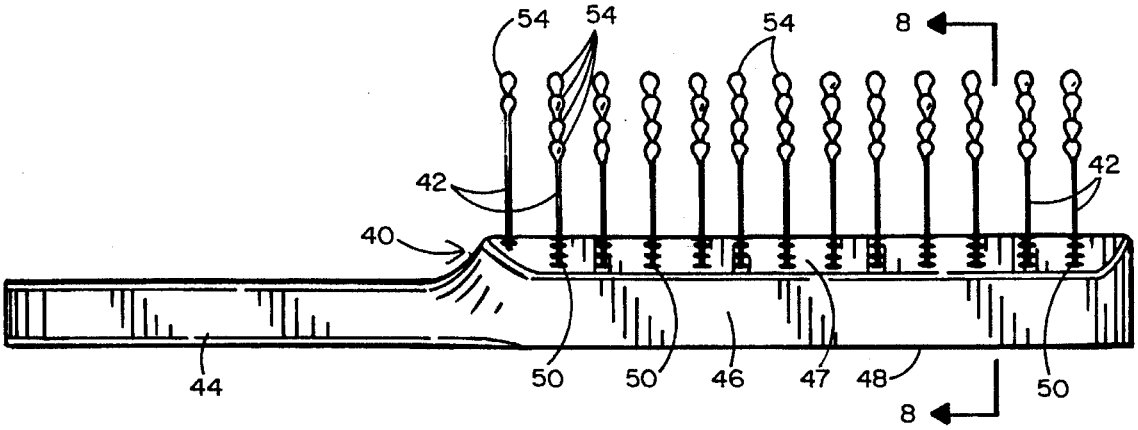
FIG. 7 is a side view of a hairbrush having a bristle carrying plate according to a third embodiment of the present invention.
Figure 8:
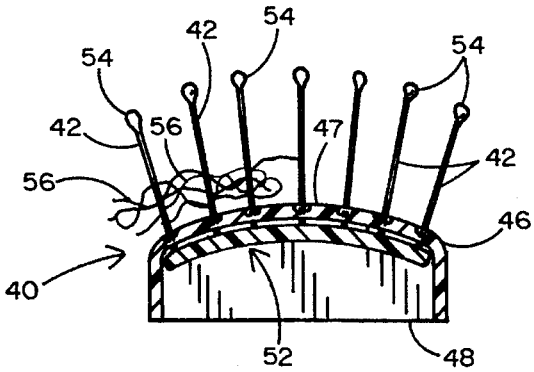
FIG. 8 is a cross-section taken along lines 8—8 of FIG. 7 showing the bristle carrying plate in an at-rest position.
Figure 9:
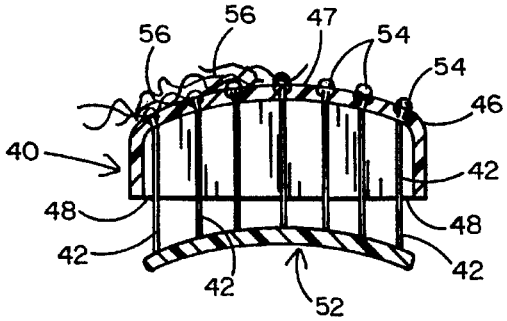
FIG. 9 is a cross-section of the hairbrush of FIG. 7 showing the bristle carrying plate moved to a brush cleaning position.

A third embodiment of a hairbrush 40 having means to collect loose strands of animal and human hair that are trapped among bristles 42 thereof so that the hair can be quickly and easily removed from the brush for disposal is described while referring concurrently to FIGS. 7–9 of the drawings. The hairbrushes 1 and 20 of FIGS. 1–6 have been previously described as including hair collecting plates 10 and 28 that slide axially along arrays of bristles between at-rest and brush cleaning positions. In the case of the hairbrush 40 of FIGS. 7–9, the bristles are moved relative to the brush head.

More particularly, and as is best shown in FIG. 7, the hairbrush 40 includes a conventional gripping handle 44 located at one end that is coextensively connected to an elongated head 46 at the opposite end. The brush head 46 is of hollow construction having a closed top face 47 and an open bottom 48. An array of holes 50 is formed through the top face 47 of brush head 46. Located within and movable through the hollow brush head 46 is a bristle carrying plate 52. An array of flexible bristles 42 projects upwardly and outwardly from the bristle carrying plate 52. The bristles 42 are individually arranged in generally spaced, parallel alignment with one another. One end of each bristle 42 is secured to the bristle carrying plate 52. Affixed to the opposite end of each bristle 42 is a smooth, generally spherical button 54. Buttons 54 of hairbrush 40 are similar to the buttons designated by reference numeral 8 and previously described when referring to the hairbrush 1 of FIGS. 1–3. Therefore, it will be understood that the thickness of each bristle 42 is less than the thickness of the button 54 carried thereon. Moreover, pockets, like those shown in FIG. 1*a*, may be formed in the holes 50 through brush head 46 to receive respective buttons 54 therewithin.

In accordance with the improvement of FIGS. 7–9, the holes 50 formed through the top face 47 of the brush head 46 of hairbrush 40 are sized to slidably receive therethrough the bristles 42 which project from bristle carrying plate 52 while maintaining the bristles 42 and plate 52 in close frictional engagement with one another. Therefore, the number and location of the holes 50 through top face 47 correspond to the number and location of the bristles 42 on plate 52. The bristle carrying plate 52 is coupled to the hairbrush 40 via the open bottom 48 of the brush head 46 by sliding the array of bristles 42 through respective holes 50 in the top face 47 of head 46. It is preferable that bristle carrying plate 52 be coupled to the hairbrush 40 prior to the step of affixing buttons 54 to the bristles 42.

In the assembled condition, the bristles 42 of hairbrush 40 are adapted to slide axially through the holes 50 in the top face 47 of brush head 46 when the bristle carrying plate 52 moves from an at-rest position inside the hollow interior of brush head 46 and flush against the top face 47 thereof (best shown in FIG. 8) to a brush cleaning position downwardly from the top face 47 and outwardly from the hollow brush head 46 through the open bottom 48 thereof (best shown in FIG. 9).

With the bristle carrying plate 52 in the at-rest position of FIG. 8, the bristles 42 extend upwardly from plate 52 and outwardly through the holes 50 in the top face 47 of brush head 46. It may be appreciated that the size of the wide buttons 54 relative to the thin bristles 42 to which the buttons 54 are attached blocks the detachment of the bristle carrying plate 52 from the hollow brush head 46 and prevents the decoupling of plate 52 from the hairbrush 40 when the bristles 42 move axially and downwardly through the holes 50 in the top face 47 of brush head 46 and the bristle carrying plate 52 is correspondingly moved to the brush cleaning position of FIG. 9 outwardly from brush head 46.

During use, with the bristle carrying plate 52 initially in the at-rest position of FIG. 8, the hairbrush 40 is used in the usual manner for grooming either humans or animals. The strands of loose hair 56 which are trapped within the bristles 42 during the brush strokes are collected atop the hairbrush 40 by moving the bristle carrying plate 52 to the brush cleaning position of FIG. 9. That is, the user pushes downwardly upon the buttons 54 at the outermost ends of bristles 42 to cause the bristles 42 to correspondingly slide downwardly through the holes 50 formed through the top face 47 of brush head 46. The downward pushing force applied to buttons 54 is transferred to the bristle carrying plate 52, whereby to cause plate 52 to move from the at-rest position of FIG. 8 inside the hollow brush head 46 to the brush cleaning position of FIG. 9 outside brush head 46 via the open bottom 48 thereof.

By virtue of the foregoing, the hair 56 that is distributed among the bristles 42 is moved to a common location above the top face 47 of brush head 46 to permit the hair 56 to be efficiently and completely removed for disposal. To reuse the hairbrush 40 after cleaning, the bristle carrying plate 52 is returned to the at-rest position of FIG. 8 by simply pushing upwardly on the plate 52 whereby to cause bristles 42 to correspondingly slide axially and upwardly through the holes 50 in the top face 47 of brush head 46 until plate 52 lies flush against face 47.

Figure 10:
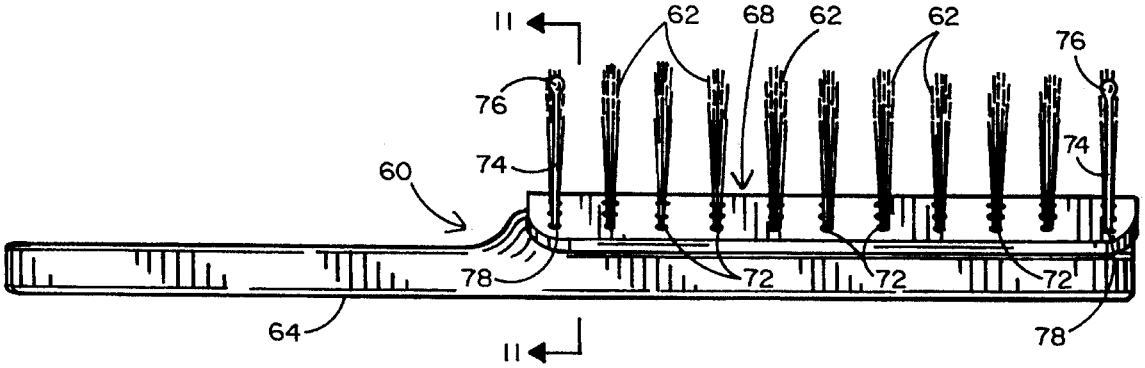
FIG. 10 shows a side view of a hairbrush having a hair collecting plate according to a fourth embodiment of the present invention.
Figure 11:
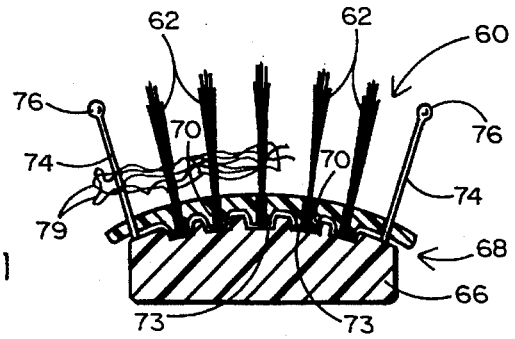
FIG. 11 is a cross-section taken along lines 11—11 of FIG. 10 showing the hair collecting plate in an at-rest position.
Figure 12:
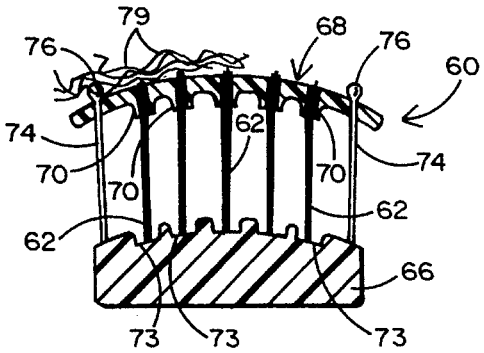
FIG. 12 is a cross-section of the hairbrush of FIG. 10 showing the hair collecting plate moved to a brush cleaning position.

A fourth embodiment of a hairbrush 60 having means to collect loose hair strands of animal and human hair that are trapped among bristles 62 thereof so that the hair can be quickly and easily removed from the brush for disposal is described while referring concurrently to FIGS. 10–12 of the drawings. The hairbrushes 1, 20 and 40 of FIGS. 1–9 have been previously described as having an array of individual bristles, each bristle being spaced from the other. The hairbrush 60 of FIGS. 10–12 includes groups of bristles 62, each group comprising a plurality of individual bristles spaced closely together.

More particularly, and is best shown in FIG. 10, the hairbrush 60 includes a conventional gripping handle 64 located at one end that is coextensively connected to an elongated head 66 at the opposite end. Groups of bristles 62 project upwardly and outwardly from the brush head 66. Each bristle 62 of the group is typically manufactured from a flexible plastic material. Each group of bristles 62 is arranged in generally spaced parallel alignment with the other groups at the top of brush head 66. One end of each bristle 62 from each group of bristles is secured to the brush head 66.

In accordance with improvement of FIGS. 10–12, a relatively thin hair collecting plate 68 is coupled to the hairbrush 60. The underside of the hair collecting plate 68 is provided (e.g. molded) with a plurality of dimples 70 projecting downwardly from the bottom of plate 68. An array of holes (designated 72 and best shown in FIG. 10) extends through the hair collecting plate 68 and the dimples 70 at the bottom thereof. The holes 72 formed through the hair collecting plate 68 and the dimples 70 are suitably sized to slidably receive therethrough the groups of bristles 62 projecting from the brush head 66. In this regard, the hair collecting plate 68 is coupled to the hairbrush 60 by sliding the groups of bristles 62 through respective holes 72 in plate 68. Therefore, the hair collecting plate 68 is adapted to slide axially along the groups of bristles 62 from an at-rest position closest to and flush against the brush head 66 (best shown in FIG. 11) to a brush cleaning position farthest from the brush head 66 (best shown in FIG. 12).

To achieve a flush fit between the hair collecting plate 68 and the head 66 of brush 60 when plate 68 is moved to the at-rest position of FIG. 11, the top of brush head 66 is provided (e.g. molded) with a plurality of recesses 73 formed in the brush head 66. Recesses 73 at the top of brush head 66 are arranged to receive therewithin respective dimples 70 at the bottom of hair collecting plate 68 to enable the brush head 66 and the hair collecting plate 68 to be mated face-to-face one another when plate 68 is in the at-rest position, whereby groups of bristles 62 project outwardly and upwardly from the holes 72 formed through the hair collecting plate 68 and the dimples 70 at the bottom thereof.

Like the hairbrush 20 of FIGS. 4–6, each of the bristles 62 from the groups thereof is free-ended (i.e. devoid of buttons, or the like). Accordingly the hairbrush 60 of FIGS. 10–12 is provided with a plurality of (e.g. four) identical guide posts 74 to prevent the removal of the hair collecting plate 68 from the groups of bristles 62 and the decoupling of plate 68 from hairbrush 60 when the plate 68 is moved upwardly along the bristles 62 to the brush cleaning position of FIG. 12. A pair of guide posts 74 is located at each end of the brush head 66. One end of each guide post 74 is secured to the brush head 66 and a smooth, generally spherical button 76 is affixed to the opposite end. Guide posts 74 should be no longer than the groups of bristles 62.

The buttons 76 carried on guide posts 74 are identical to the buttons designated by reference numeral 8 and previously described when referring to the hairbrush 1 of FIGS. 1–3. Therefore, it will be appreciated that the thickness of each guide post 74 is less than the thickness of the button 76 affixed thereto. Moreover, the hair collecting plate 68 is provided with a set of holes 78 (best shown in FIG. 10) that is suitably sized and positioned to slidably receive the guide posts 74 therethrough while maintaining the plate 68 and posts 74 in close frictional engagement with one another. It is preferable that guide posts 74 be located in respective holes 78 prior to the step of affixing buttons 76 to the free ends thereof.

During use, with the hair collecting plate 68 initially in the at-rest position of FIG. 11, the hairbrush 60 is used in the usual manner for grooming either animals or humans. The strands of loose hair 79 which become trapped among the groups of bristles 62 during the brush strokes are collected and moved away from the brush head 66 by relocating the hair collecting plate 68 to the brush cleaning position of FIG. 12. Thus, by sliding the hair collecting plate 68 axially and upwardly along the groups of bristles 62 and the oppositely aligned pairs of guide posts 74, the hair that is distributed among the bristles is collected and moved to a common location atop the brush 60 to permit the removal and disposal thereof. However, and as previously described, the buttons 76 at the free ends of guide posts 74 prevent the hair collecting plate 68 from travelling beyond the ends of the bristles 62 and separating therefrom. To reuse the hairbrush 60 after cleaning, the hair collecting plate 68 is returned to the at-rest position of FIG. 11 by simply sliding the plate axially and downwardly along the groups of bristles and the guide posts 74 so as to lie flush against the brush head 66 with the dimples 70 falling into the recesses 73.

Figure 13:
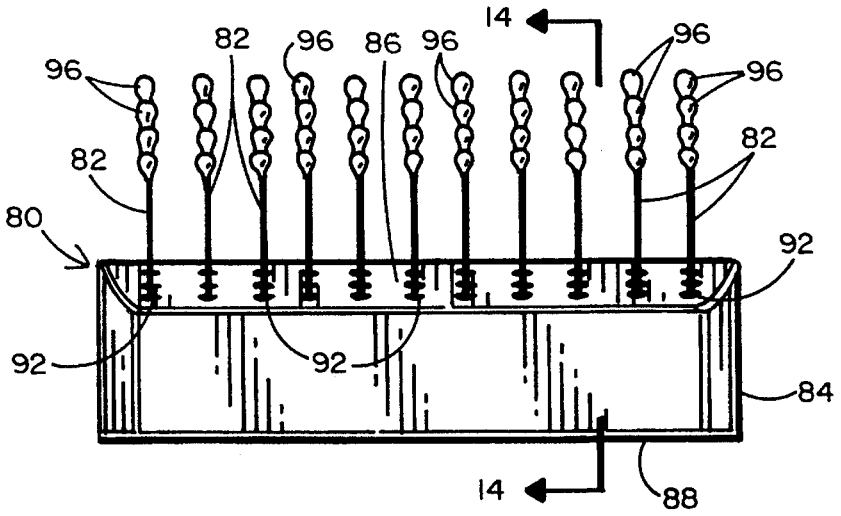
FIG. 13 is a side view of a hairbrush having a bristle carrying plate according to a fifth embodiment of the present invention.
Figure 14:
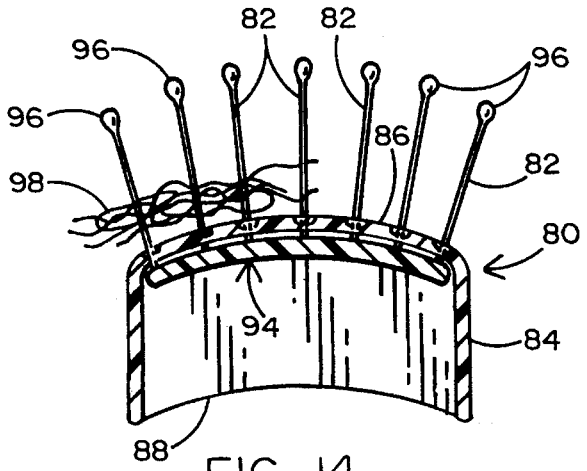
FIG. 14 is a cross-section taken along lines 14—14 of FIG. 13 showing the bristle carrying plate in an at-rest position.
Figure 15:
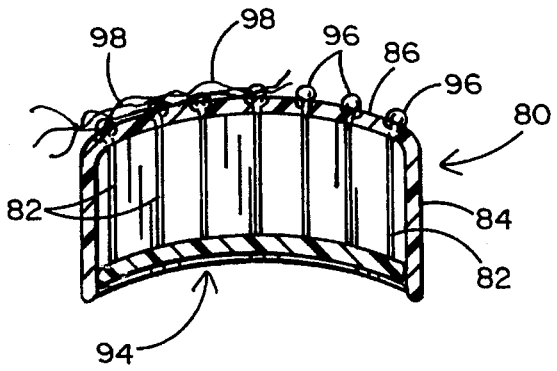
FIG. 15 is a cross-section of the hairbrush of FIG. 13 showing the bristle carrying plate moved to a brush cleaning position.

A fifth embodiment of a hairbrush 80 having means to collect loose strands of animal and human hair that are trapped among the bristles 82 thereof so that the hair can be quickly and easily removed from the brush for disposal is described while referring concurrently to FIGS. 13–15 of the drawings. The hairbrushes 1, 20, 40 and 60 of FIGS. 1–12 have been previously described as having a conventional gripping handle coextensively connected to a brush head. The hairbrush 80 of FIGS. 13–15 is otherwise characterized by a compact configuration that is devoid of the aforementioned handle and, therefore, is advantageously sized to fit entirely within the hand of a user and be conveniently carried in the user's pocket or purse.

More particularly, the hairbrush 80 includes a body 84 that is of hollow construction having a closed top face 86 and an open bottom 88. An array of holes 92 is formed through the top face 86 of body 84. Located within and movable through the hollow body 84 of brush 80 is a bristle carrying plate 94. An array of flexible bristles 82 projects upwardly and outwardly from the bristle carrying plate 94. The bristles 82 are individually arranged in generally spaced, parallel alignment with one another. One end of each bristle 82 is secured to the bristle carrying plate 94. Affixed to the opposite end of each bristle 82 is a smooth, generally spherical button 96. Buttons 96 of hairbrush 80 are similar to the buttons designated by reference numeral 8 and previously described when referring to the hairbrush 1 of FIGS. 1–3. Therefore, it will be understood that the thickness of each bristle 82 is less than the thickness of the button 96 carried thereon. Moreover, pockets, like those shown in FIG. 1*a*, may be formed in the holes 92 through brush body 84 to receive respective buttons 96 therewithin.

In accordance with the improvement of FIGS. 13–15, the holes 92 formed through the top face 86 of the body 84 of hairbrush 80 are sized to slidably receive therethrough the bristles 82 which project upwardly from bristle carrying plate 94 so as to maintain the bristles 82 and plate 94 in close frictional engagement with one another. Therefore, the number and location of the holes 92 through the top face 86 correspond to the number and location of the bristles 82 on plate 94. The bristle carrying plate 94 is coupled to the hairbrush 80 by sliding the array of bristles 82 through respective holes 92 in the top face 86 of body 84. It is preferably that bristle carrying plate 94 be coupled to the hairbrush 80 prior to the step of affixing buttons 96 to the bristles 82.

In the assembled condition, the bristles 82 of hairbrush 80 are adapted to slide axially through the holes 92 in the top face 86 of hollow body 84 when the bristle carrying plate 94 moves downwardly through the interior of the hollow brush body 84 from an at-rest position flush against the underside of the top face 86 (best shown in FIG. 14) to a brush cleaning position farthest from the top face 86, whereby to close the normally open end 88 of brush 80 (best shown in FIG. 15).

With the bristle carrying plate 94 in the at-rest position of FIG. 14, the bristles 82 extend upwardly from plate 94 and outwardly through the holes 92 in the top face 86 of brush body 84 to permit humans and animals to be groomed in the usual manner. However, it may be appreciated that the size of the wide buttons 96 relative to the thinner bristles 82 on which the buttons 96 are carried blocks the detachment of the bristle carrying plate 94 from the body 84 and the decoupling of plate 94 from the hairbrush 80 when the bristles 82 move axially and downwardly through the holes 92 in the top face 86 of brush body 84 and the bristle carrying plate 94 is correspondingly moved to the brush cleaning position of FIG. 15.

During use, with the bristle carrying plate 94 initially in the at-rest position of FIG. 14, the hairbrush 80 is used in the usual manner for grooming either humans or animals. The strands of loose hair 98 that are trapped within the bristles 82 during the brush strokes are collected atop the hairbrush 80 by moving the bristle carrying plate 94 to the brush cleaning position of FIG. 15. That is, the user pushes downwardly upon the bristles 82 to cause the bristles to correspondingly slide downwardly through the holes 92 formed through the top face 86 of brush body 84. The downward pushing force applied to bristles 82 is transferred to the bristle carrying plate 94, whereby to cause plate 94 to move from the at-rest position of FIG. 14 downwardly through the interior of hollow body 84 to the brush cleaning position of FIG. 15 across the open bottom 88 of body 84.

By virtue of the foregoing, the hair 98 that is distributed among the bristles 82 is moved to a common location above the top face 86 of brush body 84 to permit the hair 98 to be efficiently and completely removed for disposal. To reuse the hairbrush 80 after cleaning, the bristle carrying plate 94 is returned to the at-rest position of FIG. 14 by simply pushing upwardly on the plate 94 by way of the open end 88 of brush body 84, whereby to cause bristles 82 to correspondingly slide axially and upwardly through the holes 92 in the top face 86 of brush body 84 until plate 94 lies flush against the bottom of face 86.

It will be apparent that while the preferred embodiments of the invention have been shown and described, various modifications and changes may be made without departing from the true spirit and scope of the invention. For example, although the hair collecting plates and the bristle carrying plates illustrated in the drawings are shown having an arcuate shape, it is to be understood that such plates may be planer or have any other suitable shape to correspond with the configuration of the brush heads with which such plates are associated. What is more, although the buttons affixed to the bristles of the hairbrushes have been described herein as being spherical, it is to be understood that such buttons may be replaced by terminals having other suitable shapes, provided that the thickness of such terminals is wider than the thickness of the bristles to which the terminals are affixed.

Having set forth the preferred embodiments, what is claimed is:

1. A hairbrush comprising:

a body;

an array of bristles extending outwardly from said body along an axis, each of said bristles having a first end affixed to said body and a second end spaced from said body;

terminals affixed to the second ends of said array of bristles, the thickness of said terminals being greater than the thickness of said bristles; and a hair collecting plate having a plurality of holes formed therethrough to slidably receive respective ones of said array of bristles, said hair collecting plate sliding axially along said bristles from a first position adjacent the first ends of said bristles to a second position adjacent the second ends of said bristles for collecting loose strands of hair that became trapped within said bristles and relocating the strands of hair for removal from said bristles, said holes being sized to include pockets that are recessed in said hair collecting plate for receiving therewithin said terminals at the second ends of said bristles when said hair collecting plate slides along said bristles to said second position.

2. The hairbrush recited in claim 1, further comprising a hollow enclosure surrounding said body, said hollow enclosure having said hair collecting plate located at a top thereof, side walls depending from said hair collecting plate, and an open bottom located opposite said hair collecting plate, said body moving outwardly from said hollow enclosure via said open end thereof when said hair collecting plate slides from said first position to said second position for collecting and relocating the lose strands of hair for removal from said array of bristles.

3. A hairbrush comprising:

a body having at least one recess formed therein;

an array of bristles extending outwardly from said body along an axis, each of said bristles having a first end affixed to said body and a second end spaced from said body;

a hair collecting plate having a plurality of holes formed therethrough to slidably receive respective ones of said array of bristles, said hair collecting plate sliding axially along said bristles from a first position adjacent the first ends of said bristles to a second position adjacent the second ends of said bristles for collecting loose strands of hair that become trapped within said bristles and relocating the strands of hair for removal from said bristles; and hinge means extending between said body and said hair collecting plate and moving from a collapsed condition to an expanded condition when said hair collecting plate slides axially along said bristles from said first position to said second position, said hinge means moving to the expanded condition for preventing said hair collecting plate from sliding off the second ends of said array of bristles when said hair collecting plate is at said second position and said hinge means moving to the collapsed condition for receipt within said at least one recess of said body when said hair collecting plate is at said first position.

4. The hairbrush recited in claim 3, wherein said hinge means includes first and second articulating hinge members connected between said body and said hair collecting plate, said first and second articulating hinge members received within said at least one recess of said body to face one another in said collapsed condition, and said first and second articulating hinge members moving out of said at least one recess and extending in linear alignment with one another in said expanded condition.

5. A hairbrush comprising:

a body having a series of channels recessed therein;

an array of bristles extending outwardly from said body along an axis, each of said bristles having a first end affixed to said body at one of said series of channels thereof and a second end spaced from said body;

a hair collecting plate having a series of ribs projecting therefrom and a plurality of holes formed through said ribs to slidably receive respective ones of said array of bristles, said hair collecting plate sliding axially along said bristles from a first position adjacent the first ends of said bristles to a second position adjacent the second ends of said bristles for collecting loose strands of hair that become trapped within said bristles and relocating the strands of hair for removal from said bristles, said series of ribs projecting from said hair collecting plate received within said series of channels recessed within said body when said hair collecting plate is at said first position; and means to couple said hair collecting plate to said body to prevent said hair collecting plate from sliding off the second ends of said array of bristles when said hair collecting plate slides to said second position.

6. The hairbrush recited in claim 5, wherein said means to couple said hair collecting plate to said body includes at least one guide post, said at least one guide post having a first end affixed to said body and a second end spaced from said body and having a terminal connected thereto, said hair collecting plate having an opening formed therein for slidably receiving said at least one guide post therethrough so that said hair collecting plate is slidable along said at least one guide post between said first end thereof and said terminal, the thickness of said terminal being greater than the thickness of said at least one guide post.

* * * * *